US005158604A

United States Patent [19]

Morgan et al.

[11] Patent Number: 5,158,604

[45] Date of Patent: Oct. 27, 1992

[54] VISCOUS ELECTROLESS PLATING SOLUTIONS

[75] Inventors: Albert W. Morgan, Chesterfield; George D. Vaughn, Ballwin; Douglas H. Teramura, Creve Coeur, all of Mo.

[73] Assignee: Monsanto Company, St. Louis, Mo.

[21] Appl. No.: 724,093

[22] Filed: Jul. 1, 1991

[51] Int. Cl.[5] ..... C23C 18/34; C23C 18/40

[52] U.S. Cl. ..... 106/1.23; 106/1.22; 106/1.24; 106/1.26; 106/1.27; 106/1.28; 427/437; 427/438; 427/443.1

[58] Field of Search ..... 106/1.22, 1.23, 1.24, 106/1.26, 1.27, 1.28; 427/437, 438, 443.1

[56] References Cited

U.S. PATENT DOCUMENTS

| | | | |
|---|---|---|---|
| 3,329,512 | 7/1967 | Shipley et al. | 106/1.26 |
| 3,617,320 | 11/1971 | Lee | 106/1.26 |
| 4,048,354 | 9/1977 | Feldstein | 427/304 |
| 4,099,974 | 7/1978 | Morishita et al. | 106/1.23 |
| 4,220,678 | 9/1980 | Feldstein | 427/305 |
| 4,224,178 | 9/1980 | Feldstein | 252/313 |
| 4,253,875 | 3/1981 | Heymann et al. | 106/1.26 |
| 4,265,943 | 5/1981 | Goldstein et al. | 427/305 |
| 4,273,804 | 5/1981 | Feldstein | 427/97 |
| 4,425,378 | 1/1984 | Maher | 106/1.11 |
| 4,548,644 | 10/1985 | Nakaso et al. | 106/1.23 |
| 4,581,256 | 4/1986 | Sommer | 427/305 |
| 4,622,069 | 11/1986 | Akai et al. | 106/1.11 |

FOREIGN PATENT DOCUMENTS 2170982 7/1990 Japan .

OTHER PUBLICATIONS

Dialog Abstract of JP75/014617.

STN (Chem. Ab)., CA83(26):211923e, Abstract of JP75/014617.

*Primary Examiner*—Mark L. Bell

*Assistant Examiner*—Helene Klemanski

*Attorney, Agent, or Firm*—Thomas E. Kelley; Richard H. Shear

[57] ABSTRACT

Viscous aqueous electroless plating solutions comprising ionic depositable metal species such as copper or nickel, metal complexing agent such as EDTA, metal reducing agent such as formaldehyde or hypophosphite and thickener such as xantham gum, silica or carboxymethylcellulose have a viscosity greater than 50 cp, for instance up to 20,000 cp. The viscous solutions are useful for electrolessly depositing metal onto moving or inclined catalytic substrates and as a component of kits for applying electrolessly deposited metal images to such surfaces.

18 Claims, No Drawings

VISCOUS ELECTROLESS PLATING SOLUTIONS

Disclosed herein are viscous electroless plating solutions which are useful for depositing metal, e.g. copper and nickel, onto catalytic surfaces which are not amenable to immersion into baths, inclined surfaces of large objects or moving webs. Also disclosed are methods of making and using such viscous electroless plating solutions including their use in kits for field applications of electroless plating.

BACKGROUND OF THE INVENTION

A variety of materials, e.g. polymers and thickening agents, have been employed in the electroless deposition art to modify plating solutions. In certain cases the amount of additive has provided low viscosity plating solutions with enhanced properties. For instance, Shipley in U.S. Pat. No. 3,329,512 discloses low viscosity solutions for electroless deposition of copper which contain polymeric brighteners, e.g. cellulose ethers, hydroxyethyl starch, polyvinyl alcohol, polyvinylpyrrolidone, peptones, gelatin, polyamides and polyacrylamides which improve the quality of the deposit. Shipley also discloses the preparation of a 5% aqueous solution of low viscosity grade of hydroxyethyl cellulose having a viscosity of 75–150 cps; in Examples 1–4 Shipley adds the hydroxyethyl cellulose polymer solution at levels of 0.3 g/l (0.03%) providing plating baths with low viscosity, e.g. less than 10 cp, and low levels of copper, e.g. about 0.04 moles/liter. The bath of Example 43 contains a high level of copper, e.g. 0.27 moles/liter, and low levels of polymer, e.g. 50 ppm (0.05 g/1).

Morishita discloses in U.S. Pat. No. 4,099,974 low viscosity electroless copper solution containing low molecular weight (e.g. less than 6000) polyethylene glycol.

Goldstein discloses in U.S. Pat. No. 4,265,943 low viscosity electroless copper deposition solutions containing low levels, e.g. about 250 ppm (0.025%), polyethylene glycol or polyoxyethylene, which tend to slow the deposition rate.

Nakaso et al. disclose in U.S. Pat. No. 4,548,644 low viscosity electroless copper deposition solution containing 0.1 to 5 g/l of polyoxyethylene ether as a surfactant.

Sommer in U.S. Pat. No. 4,581,256 discloses low viscosity electroless plating baths containing 0.1–20 g/l of polysaccharides, e.g. sodium alginate, acacia, pectin, sodium alpha-glucoheptonate and gelatin at levels of 0.5 g/l.

Polymeric and inorganic thickeners have also been utilized in the electroless plating art for catalyst solutions, e.g. to provide catalytic inks that are amenable to silk screen printing applications. For instance, Heymann et al. discloses in U.S. Pat. No. 4,253,875 a catalytic lacquer for application by silk screen printing comprising an aqueous solution of a binding agent, a metal salt, a complex former such as EDTA, a reduction agent such as formaldehyde and, optionally organic solvents, stabilizers and fillers with thixotropic properties. Seeding with palladium is not required. The applied lacquer is dried by longtime drying at room temperature or by heating to 400° C. to provide a seed layer of the metal salt which is strengthened by immersion in a conventional metal depositing bath.

For other examples of colloidal catalytic solutions see U.S. Pat. Nos. 4,048,354; 4,220,678; 4,224,178 and 4,273,804 where Feldstein discloses catalytic solutions for initiating electroless plating comprising colloidal metal, e.g. hydrous oxide colloids of copper or nickel, stabilized with a secondary colloid such as gelatin or gum arabic.

In many cases it is desirable to apply an electroless deposition solution to a surface which is not amenable to immersion in a plating bath, e.g. because the substrate is not stable in aqueous solutions, because the substrate is large or fixed in place in a way that prohibits immersion in a solution or because it is desirable to restrict the application of plating solution to the region of a catalytic image. In such cases it would be useful to employ a highly viscous electroless plating solution that would be substantially immobilized when applied to a substrate, i.e. would not run from the localized area of application. A common belief in the field of electroless plating solutions is that plating baths must be well agitated to allow sufficient mass transfer of metal to a catalytic surface and liberation of hydrogen from the plating surface. For instance, if hydrogen, which is liberated during the reduction of ionic metal to deposited metal, is not removed from the surface, the transfer of ionic species to the surface is impeded. Such a belief has no doubt inhibited the development of highly viscous plating media.

SUMMARY OF THE INVENTION

This invention provides viscous aqueous electroless plating solutions comprising ionic depositable metal species, metal complexing agent, metal reducing agent and thickener. This invention also provides kits for applying electrolessly deposited metal images to surfaces comprising such viscous electroless plating solution and an applicator for applying said solution to desired area of a surface which is catalytic to electroless deposition. This invention also provides methods for electrolessly depositing metal onto a substrate which is catalytic to the electroless deposition of metal by coating onto such substrates a layer of a viscous aqueous electroless plating solution.

One aspect of this invention provides high viscosity electroless plating solutions having a viscosity of at least 50 cp at 25° C. as measured with a Brookfield RTV model viscometer using a No. 1 spindle at 100 rpm. Such viscous electroless plating solutions are useful in the application of electroless plating solutions to moving webs of catalytic substrate by high speed gravure printing methods or other coating techniques. Such solutions preferably have a viscosity in the range of 50 to 500 cp, more preferably in the range of 80 to 300 cp.

Another aspect of this invention provides higher viscosity electroless plating solutions having a viscosity in the range of 500 to 20,000 cp at 25° C., as measured by a Brookfield model RTV viscometer using a No. 5 spindle at 10 rpm for viscosities over 1,000 cp. Such higher viscosity electroless plating solutions can be thixotropic and are especially useful in the application of electroless plating solutions to moving webs of catalytic substrate by screen printing methods and are useful for application by brush or roller to inclined substrates, whether moving or stationary. Such higher viscosity electroless plating solutions preferably have viscosity in the range of 800 to 15,000 cp, more preferably in the range of 1,000 to 10,000 cp.

DESCRIPTION OF PREFERRED EMBODIMENTS

In the following specification and examples percentages are by weight, except for relative humidity (RH). This invention provides viscous electroless plating solutions comprising at least one ionic depositable metal species selected from groups 1B, 6B and 8 of the Periodic Chart of the Elements, at least one metal complexing agent present in molar excess of the depositable metal species, at least one reducing agent present in molar excess of the depositable metal species and sufficient thickener to provide a viscosity at 25° C. which is at least 50 cp as measured by a Brookfield RTV viscometer using a No. 1 spindle rotating at 100 rpm. The viscosity of such solutions is low enough to allow hydrogen gas generated by the deposition of metal to release from a catalytic substrate surface at a rate sufficient to allow the deposition of at least a 40 nanometer thick layer of metal onto a palladium catalyzed surface in less than 3 minutes. Preferably, the solution contains sufficient ionic metal and the viscosity of the solution is sufficiently low to allow hydrogen gas generated by the deposition of metal to release from the surface at a rate sufficient to allow the deposition of at least a 40 nanometer thick layer of metal in less than 1 minute, more preferably in less than 30 seconds, and even more preferably in less than 10 seconds, say about 5 seconds.

In many cases it is desirable that the solution be thixotropic, i.e. be resistant to flow when not subjected to shear. As used herein the term "thixotropic" refers to fluids which are typically colloidal gels or pseudoplastic fluids having the common property of reduced viscosity with shear. Thixotropic electroless plating solutions, which are colloidal gels, will flow under shear but are immobile at no shear. Thixotropic electroless plating solutions which are pseudoplastic solutions will exhibit an apparent viscosity or consistency that decreases instantaneously with an increase in shear rate.

The viscous electroless plating solutions of this invention are more preferably characterized as comprising less than 4 weight percent, more preferably less than 3 weight percent, and even more preferably between 0.1 and 2 weight percent, of at least one ionic depositable metal species selected from groups 1B, 6B and 8 of the Periodic Chart of the Elements. Useful depositable metal species from Group 1B are copper, silver and gold; from Group 6B, chromium; and from Group 8, iron, cobalt, nickel, palladium and platinum. The depositable metal species can be ,a single species or an alloy such as a copper-silver alloy, a nickel-phosphorus alloy or a nickel-iron-phosphorus alloy and the like. In preferred aspects of this invention the depositable metal species will be copper, nickel, cobalt, silver, platinum, palladium and gold; more preferably copper or nickel. The depositable metal species are conveniently provided as a water soluble salt, e.g. of a monoanion such as acetate, carbonate, chloride, citrate, hydroxide, nitrate, phosphate, pyrophosphate, sulfamate, sulfate, tatrate, or preferably a polyanion such as ethylenediamine tetracetate.

To maintain the depositable metal species in an ionic state in the presence of reducing agent, the solution contains a molar excess, compared to the metal species, of a complexing agent such as a phosphate, a tartrate, a citrate, and an ethylenediaminetetraacetate, or any of the other of a wide variety of complexing agents known by those skilled in the art to useful in electroless plating solutions. Similarly, the solution contains a molar excess, compared to the metal species, of a reducing agent such as formaldehyde, paraformaldehyde, hydrazine, a phosphite, a hypophosphite such as sodium hypophosphite, an aminoborane such as dimethylaminoborane, or a borohydride. Preferred solutions contain at least 1.5 molar equivalents, more preferably at least 2 molar equivalents, of both complexing agent and reducing agent per depositable metal species.

The thickener which provides the desired viscosity, and optionally the thixotropic character, of the electroless plating solutions of this invention can be an organic and/or inorganic thickener. Depending on the application the amount of thickener will vary. For instance, in the case of horizontal surfaces, electroless plating solution having a viscosity of less than 50 cp may not be sufficiently thixotropic or pseudoplastic, i.e. will flow readily, thereby making it difficult to retain the solution within a specified area to be plated. And, in extreme applications, e.g. to inclined surfaces or high speed moving webs, when the viscosity exceeds about 20,000 cp or when the solution contains more than about 5 weight percent by weight of thickener, the ability to deposit metal and release hydrogen by mass transfer through the solution can be significantly impeded unless the viscosity is adjusted to facilitate release of hydrogen. Preferred solutions comprise up to 4 weight percent thickener, more preferably up to 3 weight percent thickener. Preferably, the amount of ionic metal species and thickener is adjusted to allow deposition of the metal species in a layer at least 40 nanometers thick in less 3 minutes, preferably thicker layers, e.g. 100 to 300 nanometers, in less time, e.g. in less than 30 seconds. For high speed moving webs it is preferred that functional layers of metal be deposited in less than 10 seconds, say in about 5 seconds or less. Useful organic thickeners can include gelatin, carboxymethylcellulose, e.g. sodium carboxymethyl cellulose, hydroxypropyl methylcellulose, sodium polyacrylate, sodium alginate and acacia gum and xantham gum and similar viscosity enhancing or gel producing materials readily selectable by those skilled in the art. Useful inorganic thickeners can include zeolites, water glass, silica aerogel, colloidal silica or alumina, sodium silicofluoride, liquid-phase silica or alumina or bentonite colloidal clays. Mixtures of two or more thickeners may be useful for certain applications. Preferred solutions comprise as thickeners silica, xantham gum and or sodium carboxymethylcellulose. The solutions may also contain various stabilizers and other additives commonly employed in conventional electroless plating solutions which can be useful to improve stability and shelf life or appearance of metal deposit. Such additives can include acids or bases to adjust pH or stabilizers such as alkyl or alkoxy amines or sulfur compounds. In certain cases, unstable solutions, e.g. which are susceptible to autocatalytic reduction of the metal species, can be advantageously used for rapid deposition. Such unstable solutions can be prepared by continuously combining solution components e.g. in a mixing chamber, for direct feed to a surface as the solution is produced.

The substrate which is catalytic to electroless deposition can be a metal surface, e.g. steel which is scoured to remove oxides, oils and other impurities, or a polymer surface containing dispersed, e.g. clusters, of a Group 1B or Group 8 metal. Such catalytic polymeric surfaces and materials and methods for preparing them are disclosed in U.S. Pat. No. 4,910,072 and in application Ser.

Nos. 07/609,718 and 07/713,246 the disclosures of which are incorporated herein by reference.

Another aspect of this invention provides a kit for applying electrolessly deposited metal images to surfaces where the kit contains (a) a viscous aqueous electroless plating solution according to this invention and (b) an applicator for applying said solution to desired area of a surface which is catalytic to electroless deposition. Such kit can also contain one or more of (c) a dispenser containing a catalytic medium adapted to apply said catalytic medium in a pattern on a surface; (d) means for applying heat to activate a catalytic surface; (e) a dispenser for applying a masking agent to the surface; or (f) a stencil for applying said catalytic medium, said masking agent or said viscous electrolytic plating solution in a pattern. The catalytic liquid, masking agent and viscous electroless plating solution applicators can comprise a brush, dauber, roller, felt tipped pen, pressurized nozzle or other liquid applicators appropriate for the viscosity of the medium. In a preferred embodiment of this invention the catalytic liquid used in the kit is an aqueous solution of a polymer and palladium.

This invention also provides methods for electrolessly depositing metal onto a substrate comprising coating onto a substrate which is catalytic to the electroless deposition of metal a layer of a viscous electroless plating solution according to this invention. These methods include applying such solutions to substrates that are inclined from horizontal and substrates which are webs moving, for instance, at linear speeds of more than 3 meters/minute. In some cases, for instance where an initial coating of solution becomes depleted of depositable metal species or becomes so excessively viscous, e.g. due to evaporation of the solvent, that mass transfer is essentially impeded, it may be desirable to wash off the initial coating and apply one or more additional coatings.

In some cases it is useful to promote rapid deposition of metal by heating the viscous electroless plating solution, e.g. up to about 80° or 90° C., and/or by applying the solution to a catalytic surface heated, for instance, to a temperature in the range of 60° to 90° C.

The following examples serve to illustrate certain embodiments and aspects of the viscous electroless plating solutions of this invention and their use in depositing layers of metal greater than 40 nanometers thick but are not intended to imply any limitation of the scope of the invention.

EXAMPLE 1

A viscous electroless plating solution according to this invention was prepared by adding 11 g of silica (Aerosil 200 silicon dioxide from Degussa) to 200 ml of a nickel plating solution containing 6 g/l of nickel and 30 g/l of sodium hypophosphite monohydrate, producing a thixotropic gelled electroless plating solution which was heated to 60° C. and coated onto palladium-containing polymeric substrate heated to 80° C.; a layer of nickel greater than 40 nanometers thick was deposited onto the catalytic substrate.

EXAMPLE 2

A viscous electroless plating solution according to this invention was prepared by (1) adding 20 ml of XD-7055EN, a nickel plating solution component from MacDermid, to 170 ml of a 3.5% aqueous solution of hydroxypropyl methylcellulose (Methocel K15MS from Dow); (2) adding 36 drops of concentrated ammonium hydroxide and heating to 55° C.; (3) adding 12 ml of XD-7054EN, a nickel plating solution component from MacDermid; and (4) adding 10 drops of concentrated ammonium hydroxide to raise the pH to 6, producing an electroless plating solution containing 6 g/l of nickel and 30 g/l of sodium hypophosphite monohydrate having a viscosity greater than 50 cp. When the solution was coated onto palladium-containing polymeric substrate, a layer of nickel greater than 40 nanometers thick was deposited onto the substrate in 14 seconds.

EXAMPLE 3

This example illustrates the preparation of an electroless plating solution according to this invention and its application to a moving web. A catalytic printing ink containing 0.5% palladium and 0.6% polyvinyl alcohol (PVOH) was prepared by adding a palladium solution (160 g palladium acetate and 656 ml of concentrated ammonium hydroxide in 1600 ml of water) to 4800 ml of a polymer solution (1% PVOH) and diluting with 8800 ml of water. A thixotropic, viscous electroless plating solution was prepared by adding 512 g of silica (Aerosil 200 silicon dioxide from Degussa) to 16 l of nickel electroless plating solution containing 18 g/l nickel and 90 g/l sodium hypophosphite monohydrate; concentrated ammonium hydroxide was added to adjust the pH to 5.5. Images of the catalytic ink were printed onto a continuous web of polyethylene terephthalte (PET) film using a rotating gravure roll at a line speed of about 30 meters/minute. The catalytic ink was dried in an air plenum heated to 48° C.; residence time in the plenum was 3 seconds. The catalytic film was slowed to a speed of 3 meters/minute and activated by passing through an air plenum heated to 138° C.; residence time was 12 seconds.

The viscous electroless plating solution was applied to lengths of the moving (3 meters/minute) web having the activated catalytic image imprinted thereon by (a) passing the web in contact with a rotating, common napped fabric paint roller being continuously wetted with the viscous electroless solution at 25° C.; the web carried a layer of the viscous electroless plating solution through a plenum heated to 70° C. with 25% R.H. air; residence time was 30 seconds; after leaving the humidified plenum, the web was washed to remove the residual viscous electroless solution, leaving on the catalyzed surface a layer of nickel plate greater than 40 nanometers thick; and (b) passing the web in contact with a rotating metal roll being continuously wetted with the viscous electroless solution at 40° C.; the web carried a layer of the viscous electroless plating solution through a plenum heated to 65° C. with 75% R.H. air; residence time was 30 seconds; after leaving the humidified plenum, the web was washed to remove the residual viscous electroless solution, leaving on the catalyzed surface a layer of nickel plate greater than 40 nanometers thick.

EXAMPLE 4

A viscous electroless plating solution was prepared by adding to 170 ml of a 3.5% aqueous solution of hydroxypropyl methylcellulose (Methocel K15MS for Dow): 18 ml of MaCuDep 54-B, 16 ml of MaCuDep 54-A, 3.6 ml of MaCuDep 54-D and 1 ml of 37% formaldehyde (MaCuDep 54-A, B and D are copper plating bath component from MacDermid which produce in the proportions used a copper electroless plating solution containing 4 g/l copper, 0.12M EDTA and 8 g/l formaldehyde). The viscous, electroless plating solution had a viscosity greater than 50 cp and was coated onto a palladium-containing polymeric substrate; a layer of copper greater than 40 nanometers thick was deposited onto the catalytic substrate in 10 seconds.

EXAMPLE 5

This example illustrates the preparation and application of a thixotropic electroless plating solution according to this invention. A 7.5 wt % copper solution was prepared by dissolving 51.2 g of cupric disodium EDTA dihydrate in 58.8 g water to provide a solution containing 7.5 wt % copper, 34 wt % EDTA; a 4 wt % carboxymethylcellulose (CMC) solution was prepared by dissolving Aqualon 12M31P sodium carboxymethylcellulose (from Dow) in water; and a reducer solution was prepared by dissolving 0.1 g of dimethylaminoborane in 1 ml of methanol. 1 ml of the reducer solution was added to a mixture of 2.416 g of the 7.5 wt % copper solution, 1 ml of triethanolamine and 4.144 g of the 4 wt % thickener solution providing a plating solution containing about 2 wt % copper, about 10 wt % EDTA, and about 2 wt % CMC. The plating solution was applied to a catalytic polymeric surface containing reduced palladium using a 4 mil blade; the solution was allowed to stand for 3 minutes then washed off leaving as deposited a translucent copper film greater than 40 nanometers thick.

EXAMPLE 6

This example illustrates the preparation and use of a viscous electroless plating solution according to this invention. A palladium solution was prepared by mixing 0.45 g of palladium acetate, 7.5 g of water and 50 g of acetone; a polymer solutions was prepared by mixing 155 g of a 1% solution of hydroxypropyl methylcellulose (Methocel J75MS from Dow), 0.1 g of a 25% solution of surfactant (Triton X-100 polyoxyethylene from Rohm & Haas) and 237 g of water; the palladium solution and polymer solution were combined with 50 ml of water to provide a catalyst solution which was applied as a 10 micrometer thick wet film on a polyethylene terephthalate (PET) film; the catalyst film was dried in room temperature air and heated to 160° C. for 10 minutes to provide a catalytic PET film comprising an activated polymer layer containing palladium.

A viscous electroless plating solution was prepared by adding 90 ml of a hypophosphite reducing agent (Fidelity 4008-B) and 24 ml of a nickel solution (Fidelity 4008-A) to 86 g of a 0.7% solution of xantham gum (Flacon xantham gum from Pfizer); the solution contained 16.2 g/l of nickel, 84 g/l of sodium hypophosphite monohydrate and 3 g/l of xantham gum and had a viscosity greater than 50 cp. The catalytic PET film heated on was on an 85° C. hot plate then coated with the viscous electroless plating solution heated to 60° C.; after 1.5 minutes the PET film was coated with a layer of nickel greater than 40 nanometers thick.

EXAMPLE 7

This example illustrates the preparation and use of a thixotropic electroless plating solution according to this invention. A palladium solution, prepared by mixing 2.7 g palladium acetate, 50 ml water and 9.85 g concentrated ammonium hydroxide, was added to 245 ml of 1% hydroxypropyl methylcellulose, followed by 20 ml water and 125 ml of isopropyl alcohol providing a catalyst solution. A catalytic substrate was prepared by coating a 25 micrometers thick film of the catalyst solution onto a PET substrate, drying the catalyst solution at room temperature and activating by heating at 150° C. for 1 minute. A thixotropic electroless plating solution was prepared by adding 0.525 g of a 24% paraformaldehyde solution (pH 12.3) to a mixture of 0.6 g of a 7.5% copper solution (according to Example 5), 0.13 g triethanolamine, 4.16 g of a 4% sodium CMC solution and 0.19 g 50% sodium hydroxide; the solution had a pH of 12.27 and contained 0.8% copper.

A 200 micrometer thick layer of the thixotropic electroless plating solution was coated on the catalytic substrate; after 3 minutes the solution was rinsed off with water revealing a reflective copper deposit greater than 40 nanometers thick.

EXAMPLE 8

This example illustrates the preparation and use of a thixotropic electroless plating solution according to this invention. A solution was prepared by mixing 1.226 g of a 7.5% copper solution (according to Example 5), 1.316 g of 1.37 M aqueous tetrasodium EDTA, 3.03 g of 4% aqueous sodium CMC solution, 0.119 g concentrated hydrochloric acid and 0.5 ml of methanol containing 0.2 g dimethylaminoborane. A 200 micrometer thick layer of the solution was coated onto a catalytic substrate (according to Example 7); a layer of copper greater than 40 nanometers thick was deposited in one minute.

While specific embodiments have been described, it should be apparent to those skilled in the art that various modifications thereof can be made without departing from the true spirit and scope of the invention. Accordingly, it is intended that the following claims cover all such modifications within the full inventive concept.

We claim:

1. A thixotropic viscous aqueous electroless plating solution comprising at least one ionic depositable metal species selected from groups 1B and 8 of the Periodic Chart of the Elements and chromium, at least one metal complexing agent present in molar excess of the depositable metal species, at least one reducing agent present in molar excess of the depositable metal species and sufficient thickener to provide a viscosity at 25° C. which is in the range of 50 to 20,000 cp as measured by a Brookfield RTV viscometer using a No. 1 spindle rotating at 100 rpm for 50 cp viscosity and a No. 5 spindle rotating at 10 rpm for 20,000 cp viscosity; wherein the viscosity of said solution is low enough to allow hydrogen gas generated by the deposition of metal to release from a catalytic substrate surface at a rate sufficient to allow the deposition of at least a 40 nanometer thick layer of metal onto a palladium catalyzed surface in less than 3 minutes.

2. A solution according to claim 1 wherein said solution has a viscosity less than 10,000 cp as measured by a Brookfield RTV viscometer using a No. 5 spindle rotating at 10 rpm.

3. A solution according to claim 1 wherein said solution contains up to about 5 weight percent thickener.

4. A solution according to claim 2 wherein said solution is adapted to application onto moving webs by high speed gravure printing and wherein said solution has a viscosity at 25° C. in the range of 50 to 500 cp as measured by a Brookfield RTV viscometer using a No. 1 spindle rotating at 100 rpm.

5. A solution according to claim 4 having a viscosity in the range of 80 to 300 cp.

6. A solution according to claim 4 comprising between 0.1 and 2 weight percent of said depositable metal species selected from the group consisting of copper, nickel, cobalt, silver, platinum, palladium and gold; said complexing agent is selected from the group consisting of a phosphate, a tartrate, a citrate, and an ethylenediaminetetraacetate; said reducing agent is selected from the group consisting of formaldehyde, paraformaldehyde, a hypophosphite, an aminoborane and a borohydride; and said thickener is selected from the group consisting of silica, polyacrylate, alginate, xantham gum, bentonite and carboxymethylcellulose.

7. A solution according to claim 1 wherein said solution is adapted to application onto moving webs by high speed screen printing and wherein said solution has a viscosity at 25° C. in the range of 500 to 20,000 cp as measured by a Brookfield RTV viscometer using a No. 5 spindle rotating at 10 rpm for viscosities between 1,000 and 20,000 cp.

8. A solution according to claim 7 wherein said solution has a viscosity in the range of 1000 to 15,000 cp.

9. A solution according to claim 7 comprising between 0.1 and 2 weight percent of said depositable metal species selected from the group consisting of copper, nickel, cobalt, silver, platinum, palladium and gold; said complexing agent is selected from the group consisting of a phosphate, a tartrate, a citrate, and an ethylenediaminetetraacetate; said reducing agent is selected from the group consisting of formaldehyde, paraformaldehyde, a hypophosphite, an aminoborane and a borohydride; and up to 3 weight percent of a thickener selected from the group consisting of silica, polyacrylate, alginate, xantham gum, bentonite and carboxymethylcellulose.

10. A solution according to claim 2 wherein the solution contains sufficient ionic metal and the viscosity of said solution is sufficiently low to allow hydrogen gas generated by the deposition of metal to release from the surface at a rate sufficient to allow the deposition of at least a 40 nanometer thick layer of metal in less than 1 minute.

11. A solution according to claim 10 wherein said 40 nanometer thick layer of metal is deposited in less than 30 seconds.

12. A solution according to claim 11 wherein said 40 nanometer thick layer of metal is deposited in less than 10 seconds.

13. A solution according to claim 12 wherein said 40 nanometer thick layer of metal id deposited in less than 5 seconds.

14. A kit for applying electrolessly deposited metal images to surfaces comprising:

(a) a thixotropic viscous aqueous electroless plating solution comprising at least one ionic depositable metal species selected from groups 1B and 8 of the Periodic Chart of the Elements and chromium, at least one metal complexing agent present in molar excess of the depositable metal species, at least one reducing agent present in molar excess of the depositable metal species and sufficient thickener to provide a viscosity at 25° C. which is in the range of 50 to 20,000 cp as measured by a Brookfield RTV viscometer using a No. 1 spindle rotating at 100 rpm for 50 cp viscosity and a No. 5 spindle rotating at 10 rpm for 20,000 cp viscosity; wherein the viscosity of said solution is low enough to allow hydrogen gas generated by the deposition of metal to release from a catalytic substrate surface at a rate sufficient to allow the deposition of at least a 40 nanometer thick layer of metal onto a palladium catalyzed surface in less than 3 minutes; and (b) an applicator for applying said solution to desired area of a surface which is catalytic to electroless deposition.

15. A kit according to claim 14 further comprising one or more of (a) a dispenser containing a catalytic medium adapted to apply said catalytic medium in a pattern on a surface;

(b) means for applying heat to activate a catalytic surface; or (c) a stencil for applying said catalytic medium in a pattern.

16. A method of electrolessly depositing metal onto a substrate which is catalytic to the electroless deposition of metal, said method comprising coating onto said substrate a layer of thixotropic viscous aqueous electroless plating solution comprising at least one ionic depositable metal species selected from groups 1B and 8 of the Periodic Chart of the Elements and chromium, at least one metal complexing agent present in molar excess of the depositable metal species, at least one reducing agent present in molar excess of the depositable metal species and sufficient thickener to provide a viscosity at 25° C. which is in the range of 50 to 20,000 cp as measured by a Brookfield RTV viscometer using a No. 1 spindle rotating at 100 rpm for 50 cp viscosity and a No. 5 spindle rotating at 10 rpm for 20,000 cp viscosity; wherein the viscosity of said solution is low enough to allow hydrogen gas generated by the deposition of metal to release from a catalytic substrate surface at a rate sufficient to allow the deposition of at least a 40 nanometer thick layer of metal onto a palladium catalyzed surface in less than 3 minutes.

17. A method according to claim 16 wherein said substrate is inclined from horizontal.

18. A method according to claim 16 wherein said substrate is a web moving at more than 3 meters/minute.

* * * * *